US012134504B2

(12) United States Patent
Lazzareschi

(10) Patent No.: US 12,134,504 B2
(45) Date of Patent: Nov. 5, 2024

(54) MULTIPLE PACKAGE OF PACKS OF SHEETS, FORMED BY A LAMINAR MATERIAL THAT FORMS A DISPENSER AND LAMINAR MATERIAL FOR FORMING SAID PACKAGE

(71) Applicant: SOFIDEL S.P.A., Porcari (IT)

(72) Inventor: Luigi Lazzareschi, Porcari (IT)

(73) Assignee: SOFIDEL S.P.A., Porcari (IT)

( * ) Notice: Subject to any disclaimer, the term of this patent is extended or adjusted under 35 U.S.C. 154(b) by 55 days.

(21) Appl. No.: 17/832,072

(22) Filed: Jun. 3, 2022

(65) Prior Publication Data

US 2022/0411127 A1 Dec. 29, 2022

(30) Foreign Application Priority Data

Jun. 29, 2021 (IT) ..... 102021000017030

(51) Int. Cl.

| | |
|---|---|
| ***B65D 5/72*** | (2006.01) |
| ***B65D 5/02*** | (2006.01) |
| ***B65D 5/16*** | (2006.01) |
| ***B65D 5/54*** | (2006.01) |
| ***B65D 83/08*** | (2006.01) |

(52) U.S. Cl.

CPC ..... *B65D 5/725* (2013.01); *B65D 5/0227* (2013.01); *B65D 5/16* (2013.01); *B65D 5/542* (2013.01); *B65D 83/0805* (2013.01); *B65D 2583/082* (2013.01)

(58) Field of Classification Search

CPC .... B65D 5/5405; B65D 5/542; B65D 5/5445; B65D 5/0005; B65D 5/16; B65D 5/725; B65D 5/4208; B65D 83/0805; A47B 43/02; A47B 47/06

USPC ..... 229/122, 103; 206/738, 746; 221/305

See application file for complete search history.

(56) References Cited

U.S. PATENT DOCUMENTS

| | | | | |
|---|---|---|---|---|
| 1,800,550 A | | 4/1931 | Mahoney, Jr. et al. | |
| 2,891,710 A | * | 6/1959 | Repking | B65D 5/5405 206/742 |
| 3,128,984 A | * | 4/1964 | Palm | B60N 3/103 224/567 |
| 3,961,706 A | * | 6/1976 | Roccaforte | B65D 5/52 229/110 |
| 4,380,289 A | * | 4/1983 | Bigelow | B65D 77/245 206/229 |
| 5,601,230 A | * | 2/1997 | Bell | B65D 81/36 229/103 |

(Continued)

FOREIGN PATENT DOCUMENTS

| | | | | |
|---|---|---|---|---|
| GB | 2530339 A | * | 3/2016 | B65D 5/5002 |
| IT | FI960050 A1 | | 9/1997 | |

(Continued)

*Primary Examiner* — Nathan J Newhouse
*Assistant Examiner* — Phillip D Schmidt
(74) *Attorney, Agent, or Firm* — McGlew and Tuttle, P.C.

(57) ABSTRACT

A multiple package of packs of sheet products includes a box, inside which the packs of sheet products are accommodated. The box is formed by a folded laminar material. A first portion of the laminar material delimited by first pre-cut lines is adapted to form a first dispenser for at least one of said packs of sheet products. The first dispenser is obtainable by detaching the first portion of laminar material from the box along the first pre-cut lines and folding it along respective fold lines.

11 Claims, 12 Drawing Sheets

(56) References Cited

U.S. PATENT DOCUMENTS

| | | | | |
|---|---|---|---|---|
| 6,439,386 | B1 * | 8/2002 | Sauer | B65D 5/4208 221/45 |
| 6,966,483 | B2 * | 11/2005 | Manninen | B65D 5/4229 229/906 |
| 6,976,605 | B2 * | 12/2005 | Mitchell | B65D 5/4208 221/199 |
| 7,958,994 | B2 * | 6/2011 | Weinmann | B65D 5/725 221/102 |
| 8,695,848 | B2 * | 4/2014 | Cook | B65D 83/0805 206/436 |
| 8,915,420 | B2 * | 12/2014 | Masague | B65D 5/6605 229/126 |
| 11,325,743 | B2 * | 5/2022 | Simpkins | B65D 5/5445 |
| 11,470,988 | B2 * | 10/2022 | Sharon | B65D 5/52 |
| 2006/0191983 | A1 * | 8/2006 | Cargile | B65D 81/368 229/103 |
| 2018/0317736 | A1 * | 11/2018 | Goldberg | A47L 13/52 |

FOREIGN PATENT DOCUMENTS

| | | | | |
|---|---|---|---|---|
| KR | 200454886 | Y1 * | 8/2011 | |
| WO | WO-2004103833 | A1 * | 12/2004 | B65D 5/4208 |
| WO | WO-2011145942 | A1 * | 11/2011 | B65D 25/20 |

* cited by examiner

MULTIPLE PACKAGE OF PACKS OF SHEETS, FORMED BY A LAMINAR MATERIAL THAT FORMS A DISPENSER AND LAMINAR MATERIAL FOR FORMING SAID PACKAGE

TECHNICAL FIELD

The present invention relates to the field of sheet products, for example interfolded cellulose sheets, for domestic or professional use. More in particular, the present invention concerns improvements to multiple packages that contain two or more packs of sheets.

BACKGROUND ART

Many sheet products for hygiene or for cleaning, both for domestic and professional use, are marketed in packs that are in turn packaged in multiple packages, containing two, four, six or more packs of sheet products. Typically, these products are produced by cellulose sheets, or also by non-woven sheets, or the like. Often the sheets are folded and interfolded with one another, so as to be taken individually from a dispenser.

In some cases, the packs of sheets are packaged in a wrapping film, for example a plastic film. The user tears the wrapping film and places the pack of sheets in a dispenser for repeated use, for example made of plastic or metal.

In some cases, the dispenser is made, for example, of cardboard and is sold together with the pack of interfolded sheets, of which it forms the packaging box. The dispenser is opened by tearing a strip of cardboard along a perforation line, which is removed to leave an elongated opening for removing the sheets contained in the dispenser. When the pack of sheets is finished, the dispenser is discarded.

This type of dispenser is very practical for the user, but represents a considerable source of pollution and of waste of raw materials, above all if the empty dispenser is not disposed of correctly as recyclable waste.

Therefore, there is the need to provide a dispenser that eliminates or reduces the problems of the dispensers of the prior art.

SUMMARY OF THE INVENTION

Substantially, according to one aspect, a multiple package of packs of sheet products, for example of interfolded sheets of web material, is provided, which comprises a box, inside which the packs of sheet products are accommodated. The box is formed by a folded laminar material. At least a first portion of the laminar material delimited by first pre-cut lines is adapted to form a dispenser for at least one pack of sheet products contained in the package. The dispenser is obtainable by detaching the first portion of laminar material from the box along the first pre-cut lines and folding it along respective fold lines.

In this way, the box, which is normally discarded after having removed the packs of sheets therefrom, is used a second time transforming it at least in part into a dispenser to dispense the single sheets of each pack contained in the package.

As will be clear from the description of some embodiments set forth below, the sheet dispenser can be formed by a single portion or by a plurality of mutually combined portions of laminar material.

The laminar material can typically be cardboard, specifically corrugated board, suitably cut, scored and perforated or pre-cut along the pre-cut lines that form the portion or portions of laminar material with which the dispenser is assembled.

According to a further aspect, a laminar material for producing a box by folding along respective fold lines is provided. The laminar material comprises at least a first portion of laminar material delimited by pre-cut lines on which fold lines are produced. The first portion of laminar material is configured to be separated from the remaining part of the laminar material along the pre-cut lines and folded along the fold lines to form a first dispenser of sheet products.

Further advantageous features and embodiments of the laminar material and of the package that can be produced therewith are described below and defined in the appended claims, which form an integral part of the present description.

BRIEF DESCRIPTION OF THE DRAWINGS

The invention will be better understood by following the description and the accompanying drawings, which illustrate non-limiting examples of embodiment of the invention. More in particular, in the drawing.

DETAILED DESCRIPTION

Figure 1:
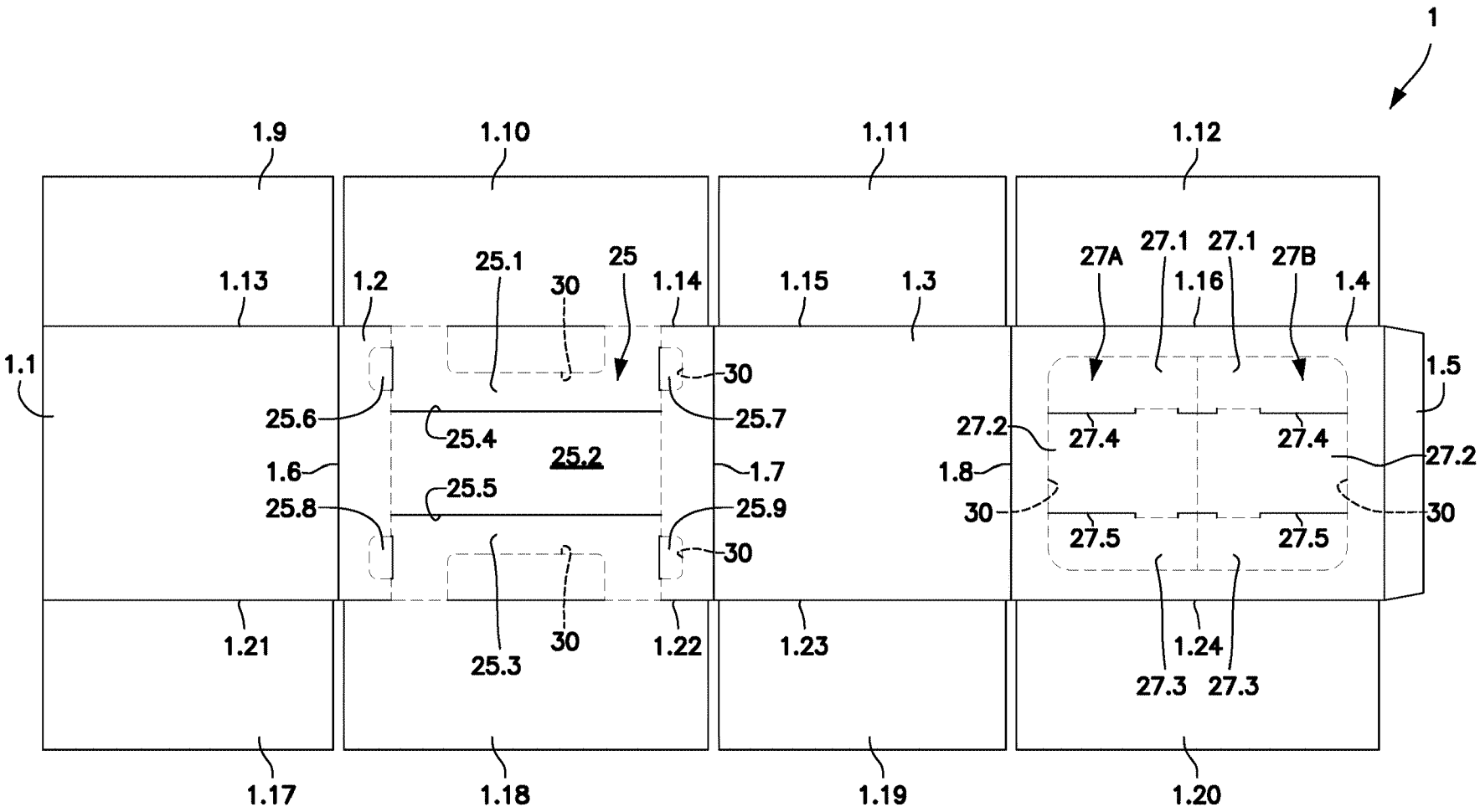
FIG. 1 shows a flat view of a laminar material cut and scored to form a box forming the outer casing of a multiple package of packs of folded and interfolded sheets.

FIG. 1 shows a flat view of a sheet of laminar material 1 for producing a box forming the outer casing of a package of packs of sheets, for example made of cellulose material, such as tissue paper or the like. The sheets can be folded and interfolded.

In exemplary embodiments, the laminar material 1 is formed by corrugated board. The corrugated board can be single wall, i.e., formed by two sheets of smooth paper, also called liners, between which a sheet of fluted paper is glued. It would also be possible to use a multiple flute corrugated board, or a laminar material other than corrugated board, for example a sheet of plastic material, for example bioplastic or polymer material. Hereinafter, for the sake of brevity, reference will be made specifically to corrugated board.

Figure 2:
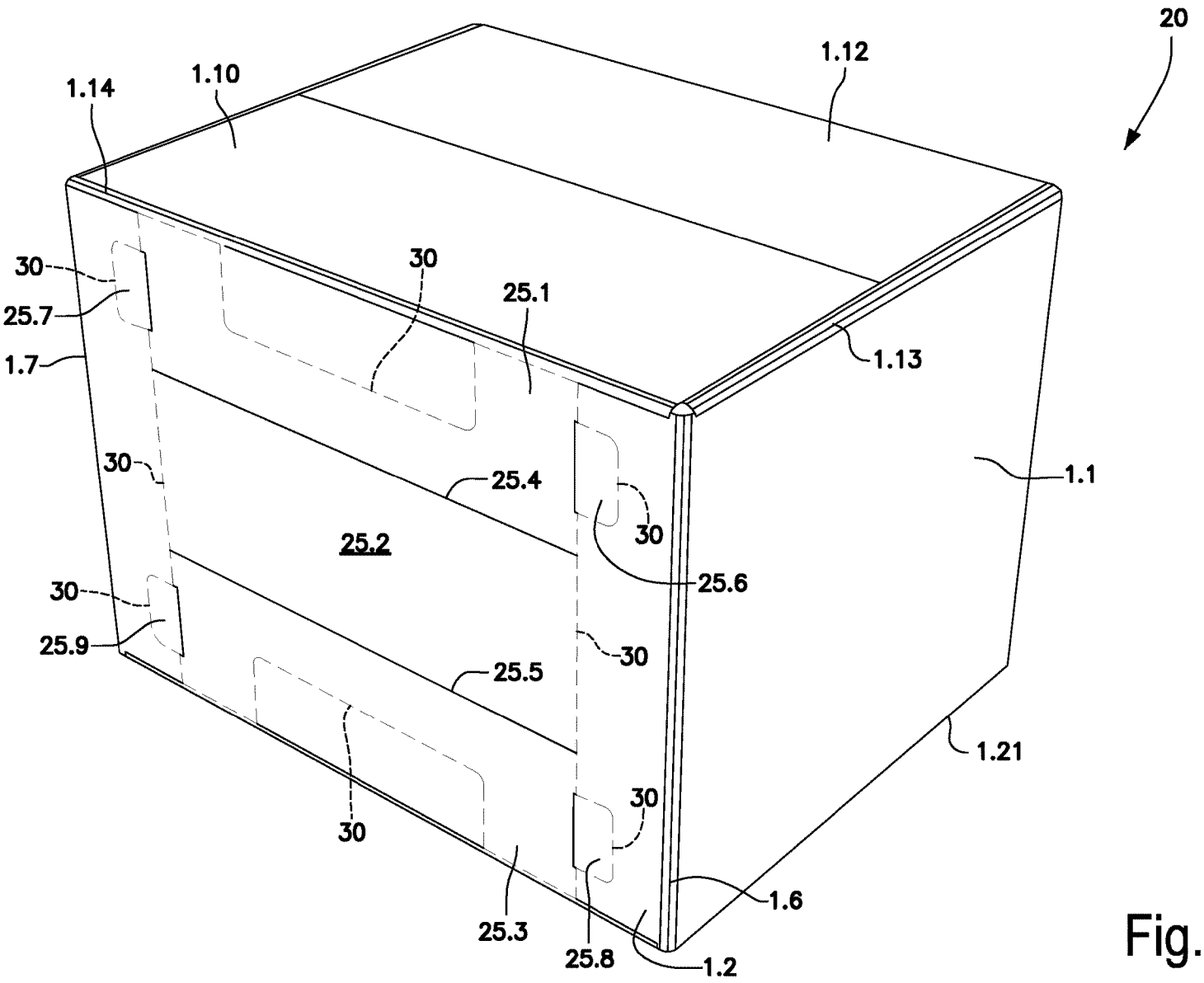
FIGS. 2 and 3 show a package in the form of box, assembled with the laminar material of FIG. 1.
Figure 3:
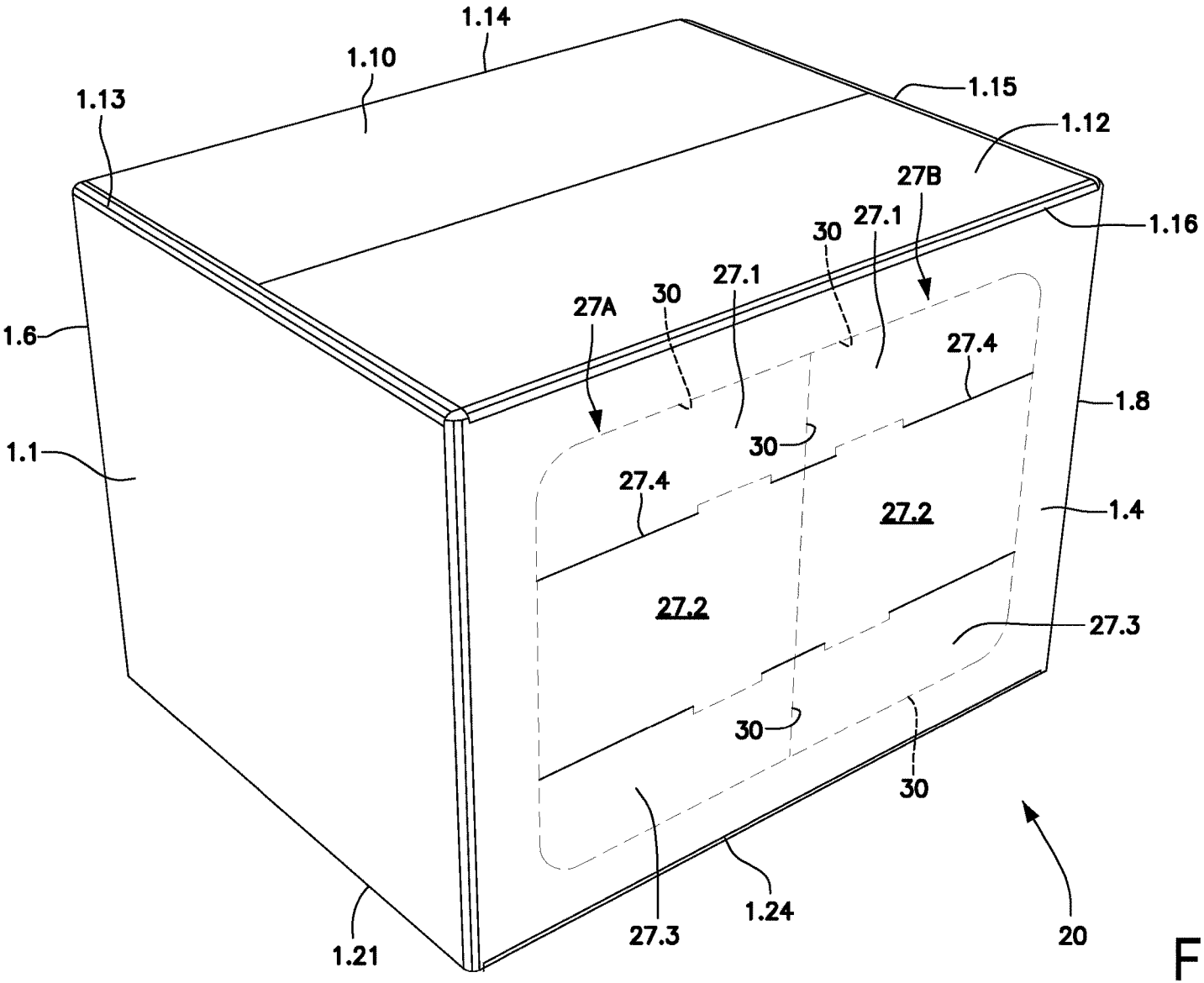
Figure 7:
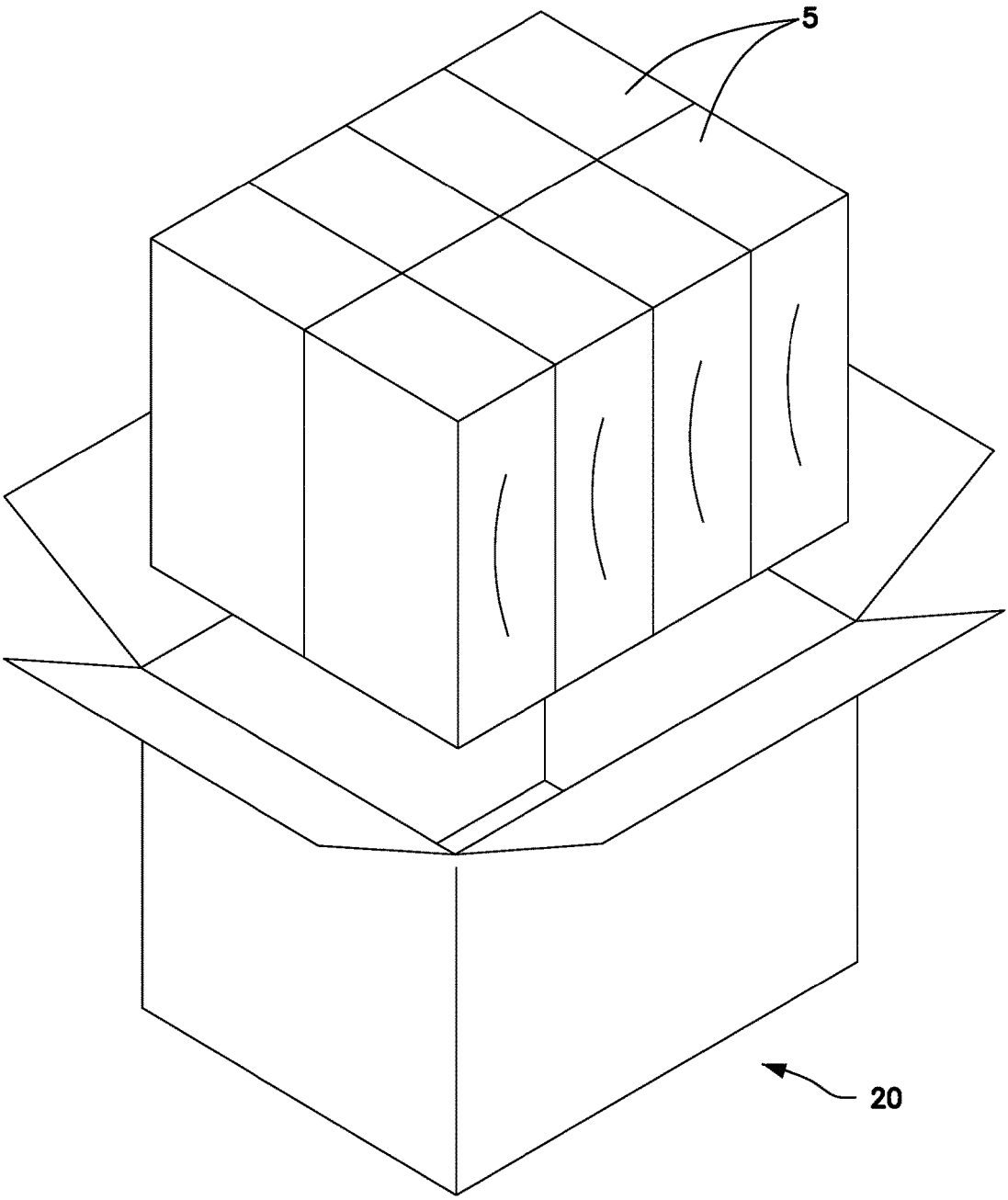
FIG. 7 shows an axonometric view of the box in a step of filling with the packs of folded and interfolded sheets.
Figure 16:
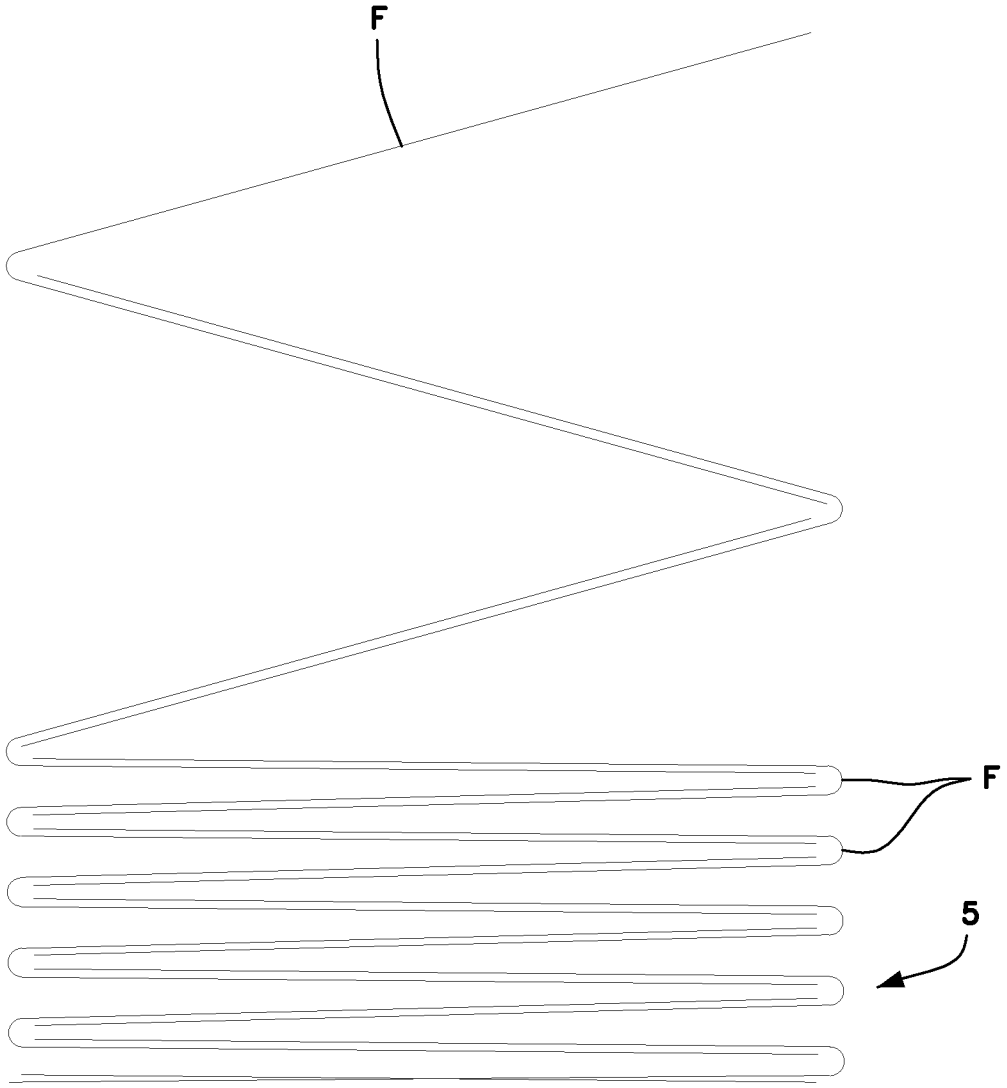
FIG. 16 shows a simplified side view of a pack of folded and interfolded sheets made of cellulose material.

As described in greater detail below, the laminar material 1 has cut and scored lines and a shape such that, by folding the laminar material 1 a prismatic shaped box is obtained for containing single packs of sheets, for example of folded and interfolded sheets of cellulose material. FIGS. 2 and 3 show the box formed and closed, indicated with 3. FIG. 7 shows the box partially open during the insertion of eight packs 5 of sheets F therein. FIG. 16 schematically shows a portion of a pack of folded and interfolded sheets F in a schematic side view.

The laminar material 1 has four substantially rectangular panels 1.1, 1.2, 1.3 and 1.4, joined to one another along scored lines 1.6, 1.7 and 1.8, forming fold lines. Reference number 1.6 indicates an end flap that, when the box is formed, is glued along the free edge of the panel 1.1. Reference numbers 1.9, 1.10, 1.11 and 1.12 indicate panels connected to the panels 1.1, 1.2, 1.3 and 1.4 along respective scored lines 1.13, 1.14, 1.15 and 1.16. The panels 1.9-1.12 form the top closure of the box. Likewise, reference numbers 1.17, 1.18, 1.19 and 1.20 indicate panels connected to the panels 1.1, 1.2, 1.3 and 1.4 along respective scored lines 1.21, 1.22, 1.23 and 1.24. The panels 1.17-1.20 form the bottom closure of the box.

FIGS. 2 and 3 show two opposite axonometric views of the box 20 obtained by folding the panels of the laminar material 1.

A few packs 5 of interfolded sheets F can be inserted into the box 20, as shown by way of example in FIG. 7. The shape and the size of the box 20 illustrated in the accompanying drawings is purely an example and it must be understood that boxes of different shapes and sizes can also be provided, for example to contain a different number of packs 5 and/or a different arrangement of the packs 5 inside the box 20.

Characteristically, one or more portions of laminar material detachable from the box 20 to form a dispenser are formed in the laminar material 1, by means of pre-cut lines, for example perforation lines. For example, FIG. 1 shows three portions of laminar material, indicated with 25, 27A and 27B. For a better understanding, in FIG. 4 the three portions of laminar material 25, 27A, 27B are shown separated from the rest of the laminar material 1.

More in particular, the portion of laminar material 25 has approximately the shape of an H with three zones 25.1, 25.2 and 25.3 joined to one another by two mutually parallel scored lines 25.4 and 25.5. The portion of laminar material 25 further comprises two tabs 25.6 and 25.7, joined to opposite edges of the portion 25.1 along respective scored lines, and two tabs 25.8 and 25.9, symmetrical to the previous tabs, joined to opposite edges of the portion 25.3 along respective scored lines.

The portion of laminar material 25 is obtained in the panel 1.2 of the laminar material 1 by pre-cut lines, for example perforation lines, indicated with a dashed line and all marked with the number 30 in FIG. 1.

The two portions 27A and 27B of laminar material are symmetrical to each other and each has a central portion 27.1 and two lateral portions 27.2, 27.3, joined by scored lines 27.4, 27.5. Slots or incisions 27.6 and 27.7, respectively, are provided along each scored line.

The two portions 27A, 27B are formed in the panel 1.4 of the laminar material 1 and are delimited by pre-cut lines, for example perforation lines, indicated with a dashed line in FIG. 1 and all marked with the reference number 30.

Figure 5:
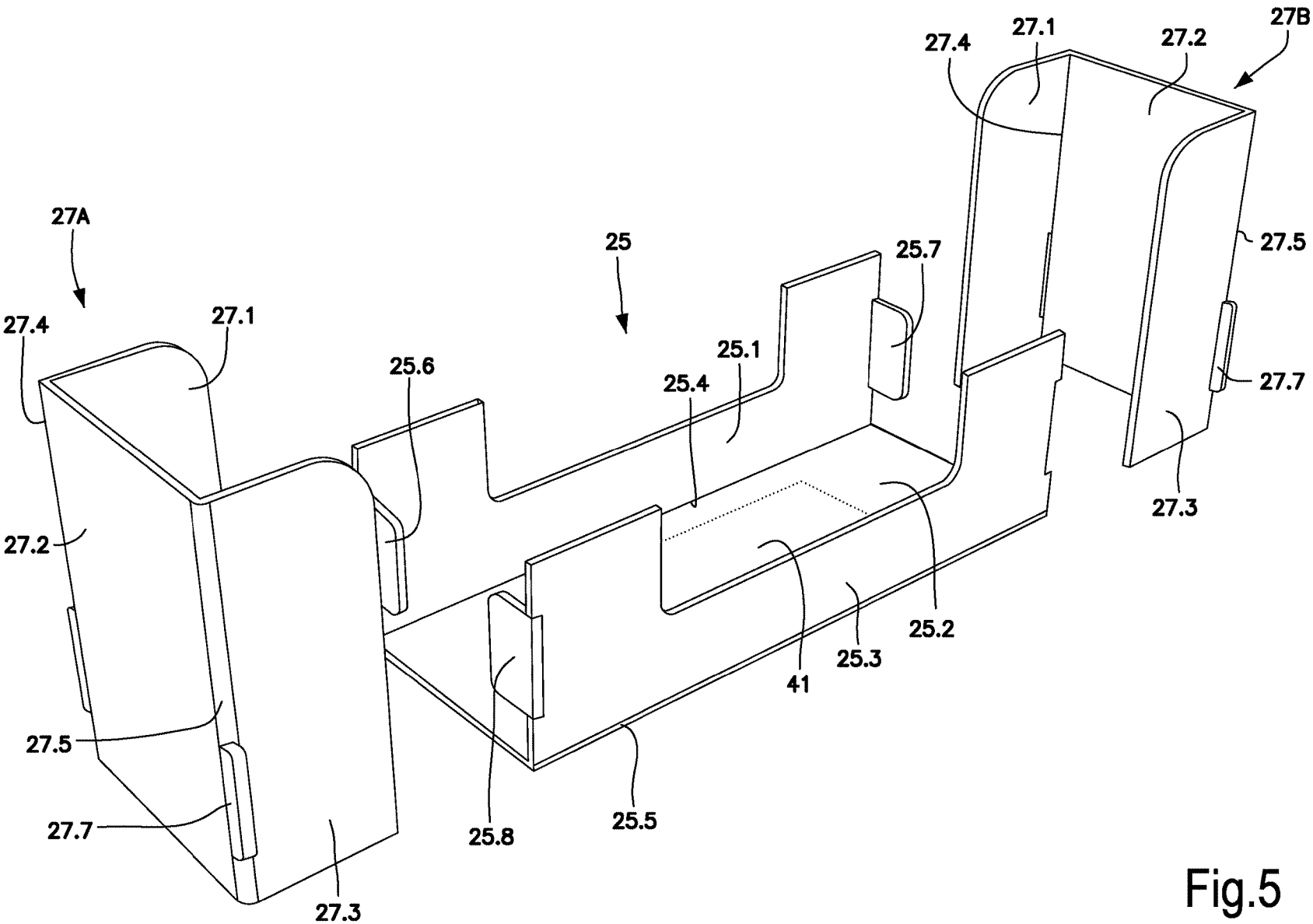
FIG. 5 shows an axonometric view of a dispenser obtained from assembly of the portions of laminar material of FIG. 4 in a step of assembly.
Figure 6:
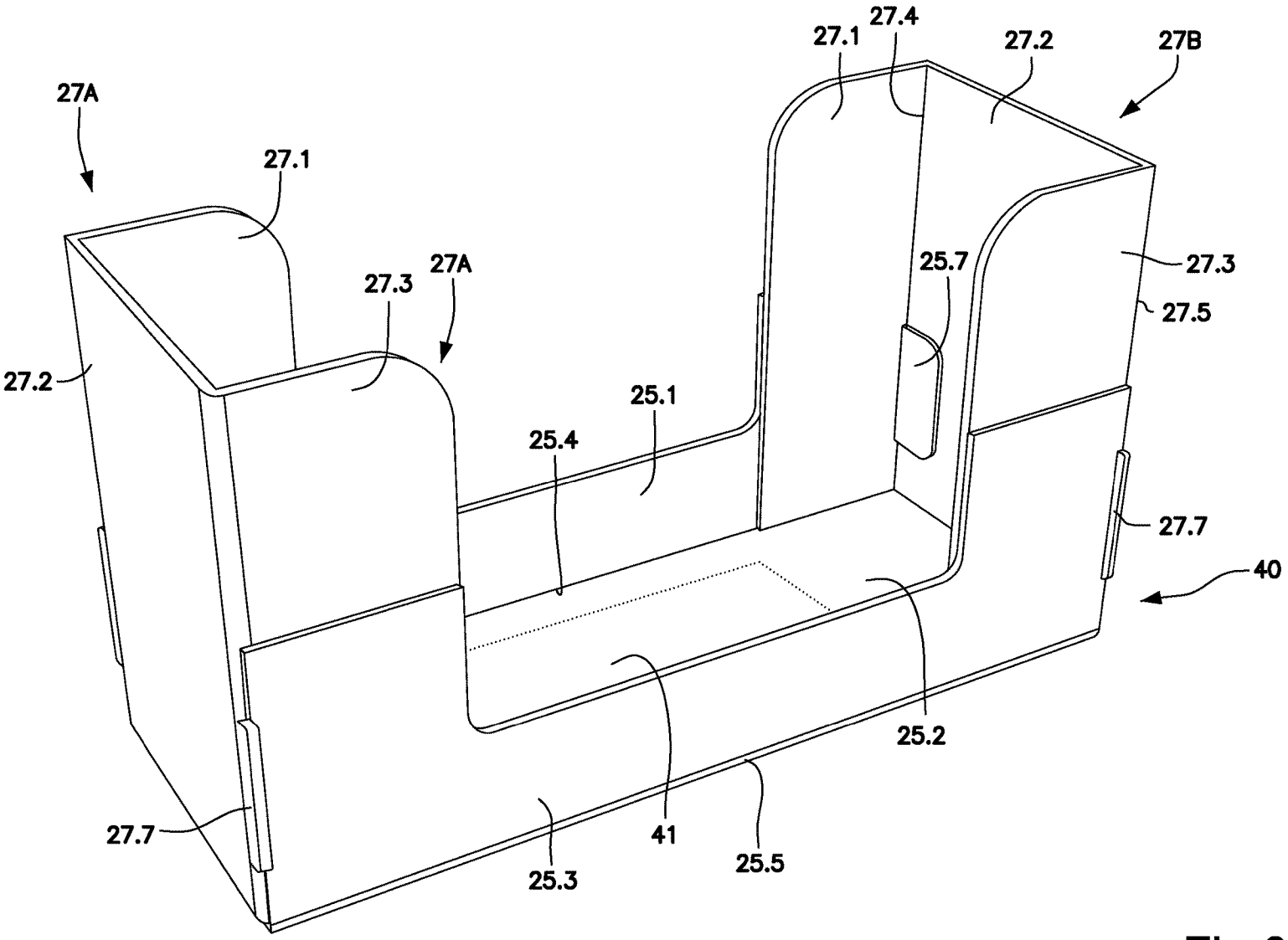
FIG. 6 shows the assembled dispenser.

The three portions 25, 27A, 27B of laminar material can be detached from the box 20 once this has been opened to extract the packs 5 of sheets F therefrom. FIG. 5 shows the three portions 25, 27A, 27B folded along the respective fold or scored lines before their assembly. In FIG. 6 the three portions are shown in the layout assembled to form a dispenser 40, in which the packs 5 of folded and interfolded sheets F can be placed. To keep the portions 25, 27A, 27B joined to one another, the tabs 25.6-25.9 are folded and inserted into the incisions 27.6, 27.7 of the portions 27A, 27B.

In this way, the package of packs 5 contained in the box 20 can be used after opening of the box 20 and removal of the packs 5, by assembling the dispenser 40. If the box 20 is larger and contains a larger number of packs 5, it would be possible to provide, in the laminar material 1 that forms it, a larger number of detachable portions of laminar material, with which to form two dispensers 40 instead of one.

In some embodiments, a double-sided adhesive 41 can be applied to one of the portions of laminar material intended to form the dispenser 40, for example to the surface of the portion of laminar material which is positioned on the outside of the dispenser 40 when the dispenser is assembled. The double-sided adhesive 41 can be formed by a substrate that has an adhesive on a surface adhering to the laminar material and a second adhesive on the opposite surface, facing towards the outside of the dispenser, suitably protected by a detachable protective film. In this way, the dispenser 40 can be attached to a supporting surface.

Figure 4:
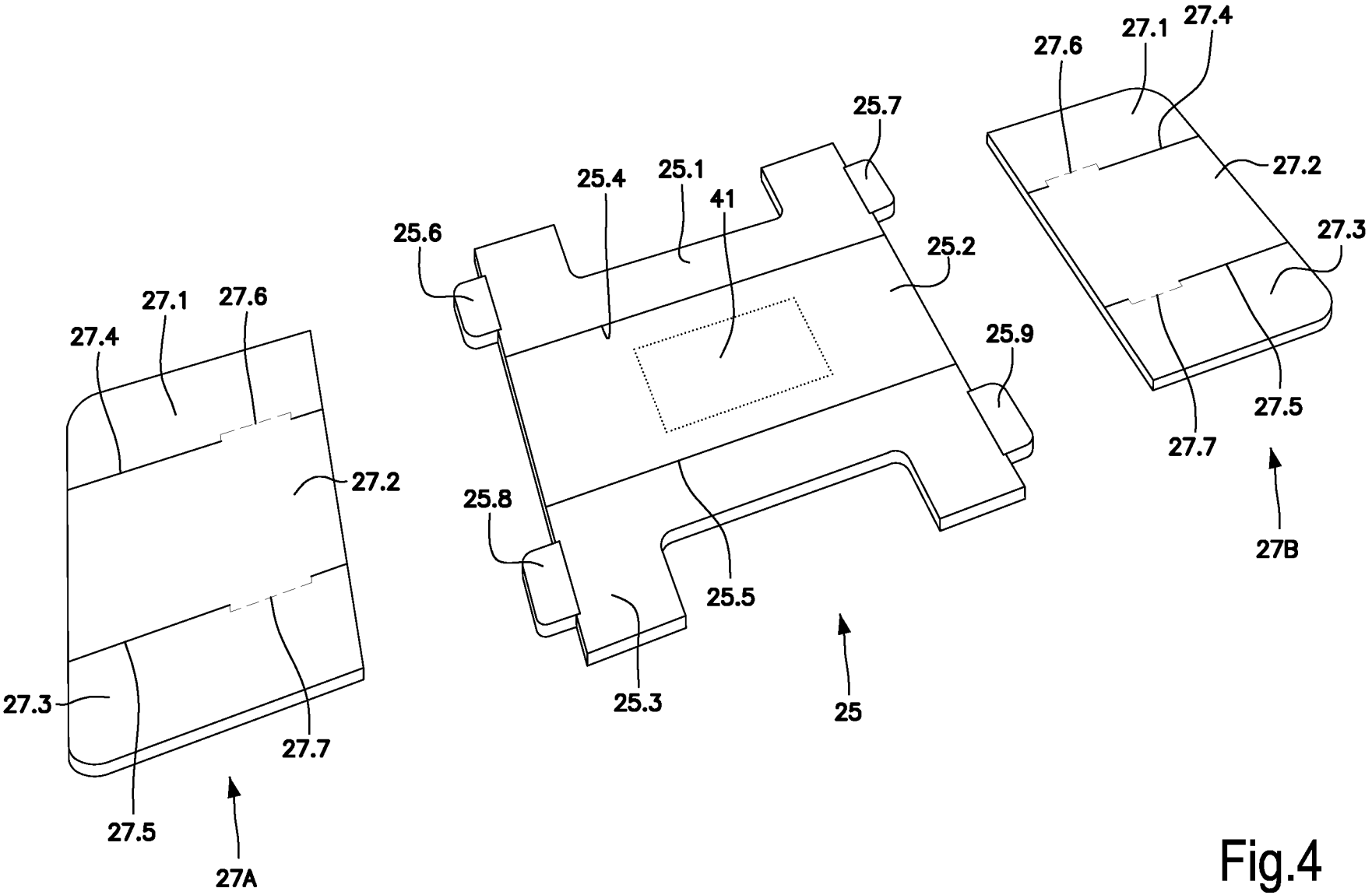
FIG. 4 shows a view of the portions of laminar material detached from the box of FIGS. 2 and 3, with which the dispenser for the folded and interfolded sheets is formed.

A double-sided adhesive 41 of this type is shown indicatively in FIGS. 4, 5 and 6. It must be understood that the position in which the double-sided adhesive 41 is shown is by way of example and not binding.

FIG. 1 and FIGS. 4, 5 and 6 show a non-limiting exemplary embodiment of a dispenser that can be obtained from parts of laminar material detached from the box 20 along the pre-cut lines 30. In fact, many different shapes of portions of laminar material can be obtained in the laminar material 1 to build a dispenser 40 therewith. Further exemplary embodiments are shown in FIGS. 8 to 15.

Figure 9:
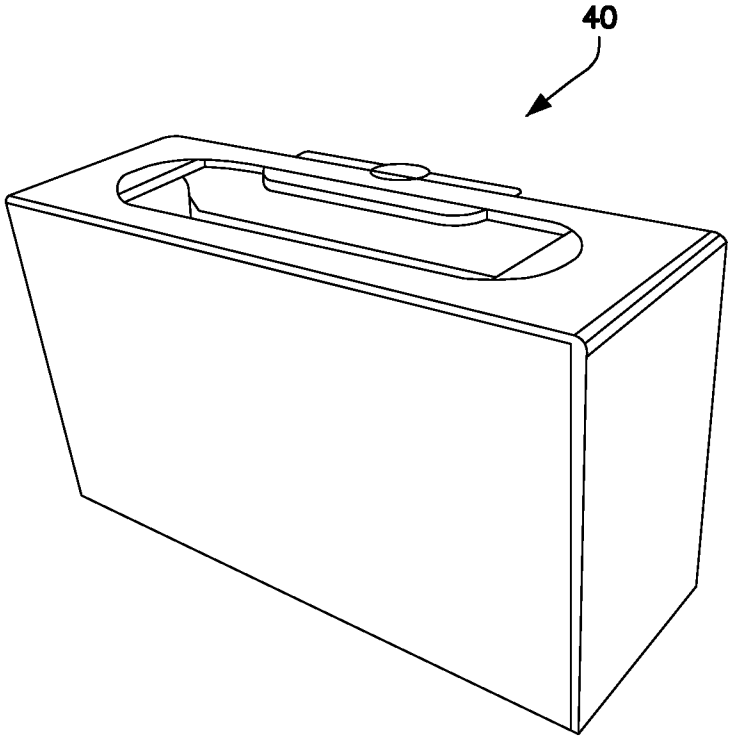
FIGS. 8 to 15 show examples of possible dispensers and respective flat views of the laminar material cut and scored to produce them.
Figure 8:
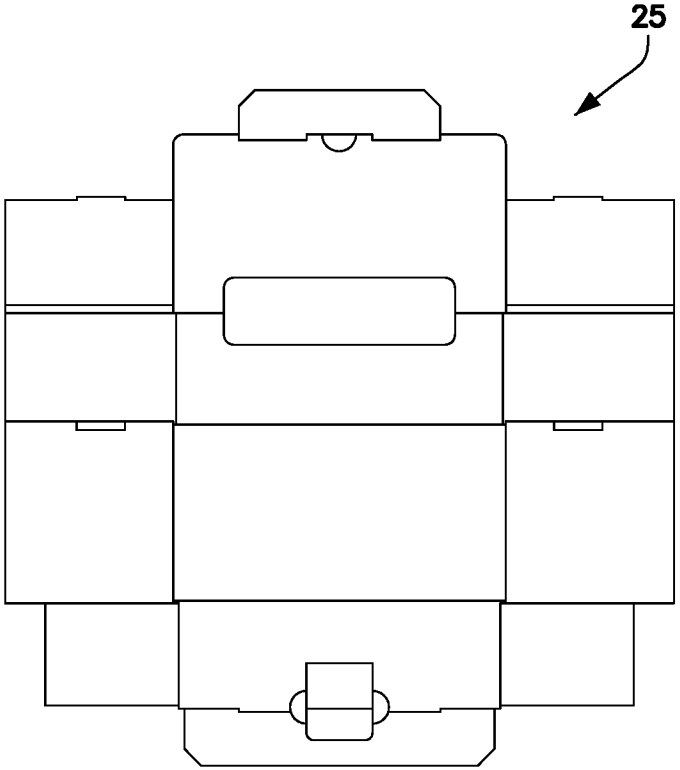

More in particular, FIG. 8 shows a flat view of a portion of laminar material 25 with relative scored lines, which can be obtained from the laminar material 1 forming the box 20. FIG. 9 shows the dispenser obtained by folding the portion of laminar material of FIG. 8.

Figure 11:
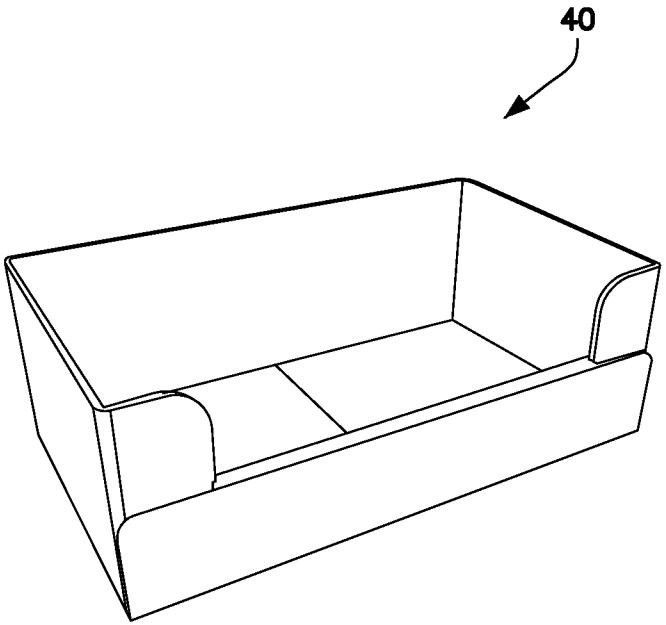
Figure 10:
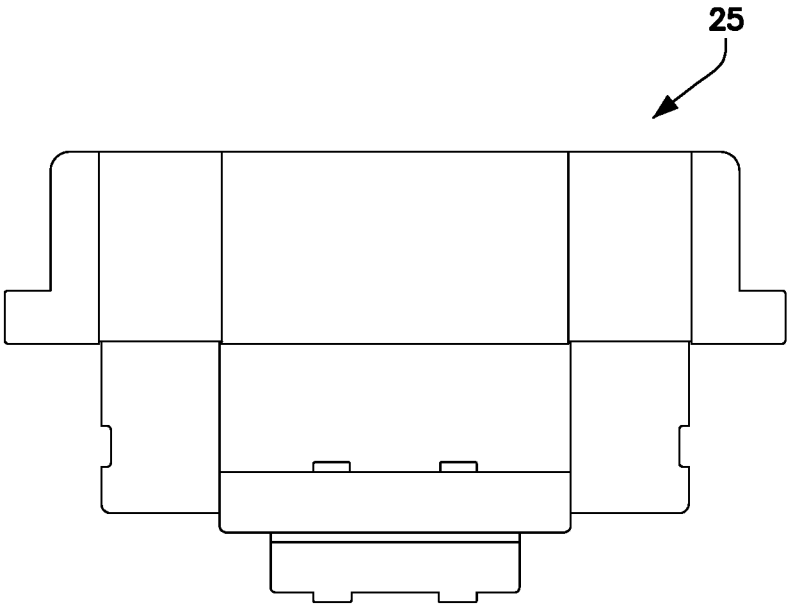

FIG. 10 shows a different embodiment of a portion of laminar material 25, with which the dispenser of FIG. 11 can be obtained.

Figure 13:
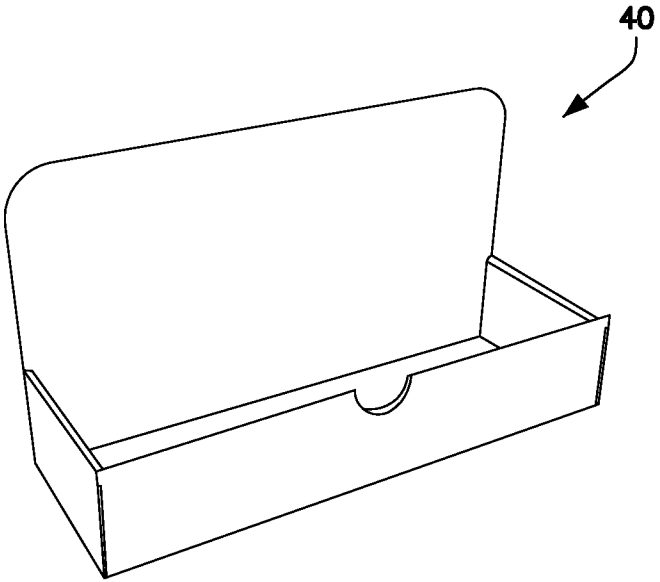
Figure 12:
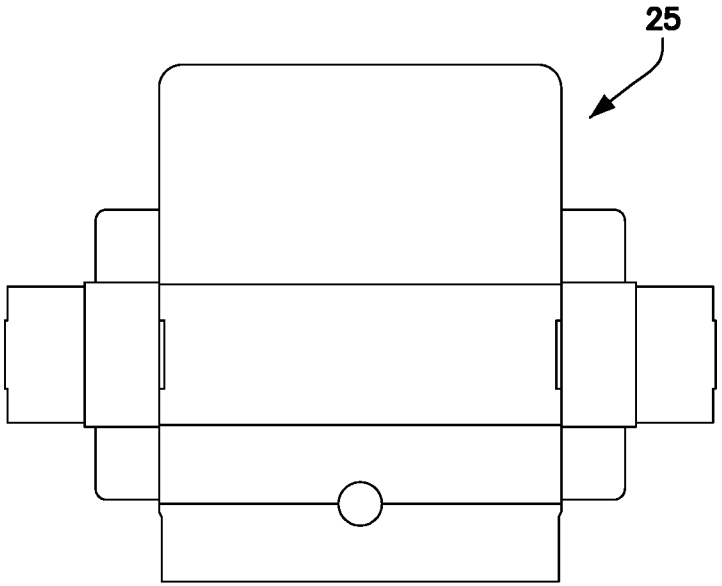

FIG. 12 shows yet another portion of laminar material 25, with which a dispenser of the type illustrated in FIG. 13 can be formed.

Figure 15:
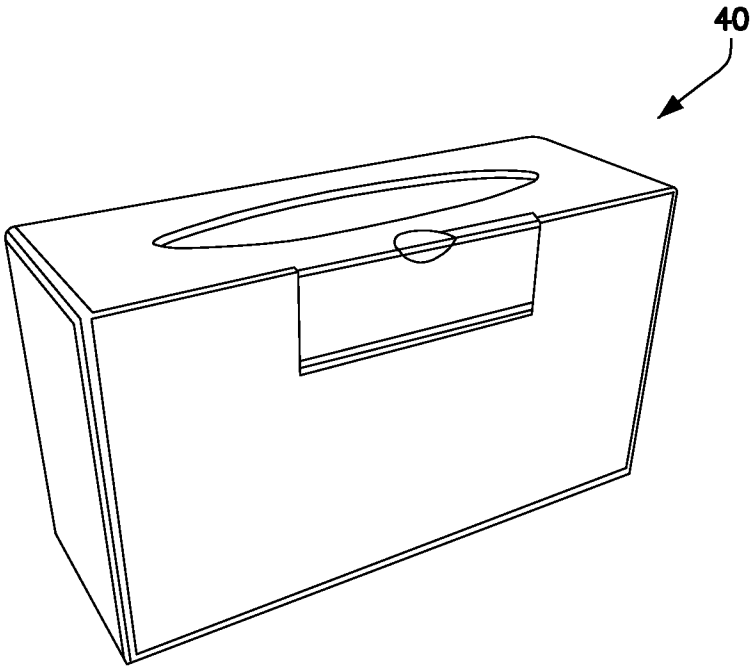
Figure 14:
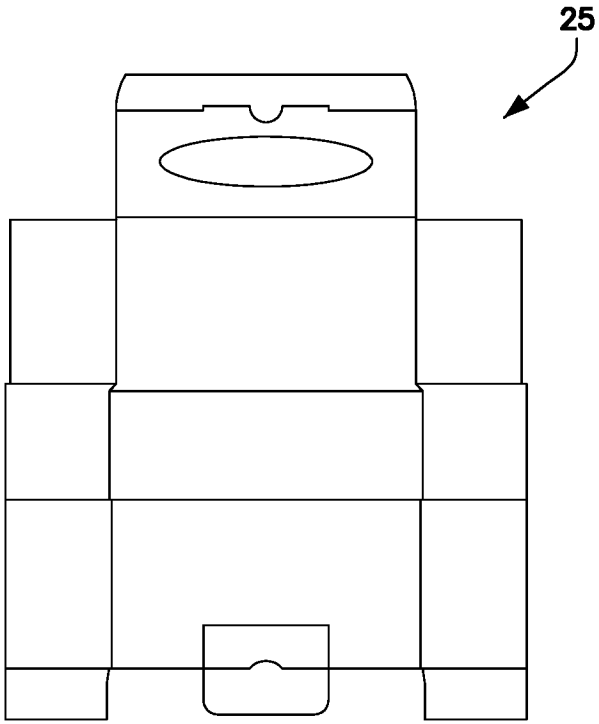

Finally, FIG. 14 shows yet another example of a portion of laminar material 25, with which a dispenser 40 of the type illustrated in FIG. 15 can be produced.

Contrary to the embodiment of FIGS. 1 to 6, the embodiments of FIGS. 8 to 15 provide for a single portion of laminar material 25, which allows a dispenser 40 to be formed (by folding and interlocking of lateral tabs in corresponding incisions).

While in FIG. 1 the portions 25, 27A, 27B of laminar material intended to form the dispenser 40 are obtained separately on different panels of the laminar material 1 that forms the box, in other exemplary embodiments the portion of laminar material 25 intended to form the dispenser can extend on two or more contiguous panels of the laminar material 1, for example by aligning one or more of the scored lines of the portion of laminar material 25 with respective scored lines along which the laminar material 1 is folded to form the box 20.

As mentioned above, in particular for boxes 20 of large size, several portions of laminar material 25 or 25, 27A, 27B can be provided, to form two or more dispensers therewith.

What is claimed is:

1. A multiple package of packs of sheet products, wherein the package comprises a box, inside which a plurality of packs of sheet products are accommodated; wherein the box is formed by a folded laminar material; wherein at least a first portion of the laminar material delimited by first pre-cut lines is adapted to form a first dispenser for at least one of said packs of sheet products; and wherein the first dispenser is obtainable by detaching the first portion of laminar material along the first pre-cut lines from the box and folding the first portion of laminar material along respective fold lines to form said first dispenser, said dispenser being adapted to dispense individual sheet products from said at least one pack of sheet products;

the first portion of laminar material comprises a plurality of portions of laminar material, delimited by respective pre-cut lines, each portion of said plurality of portions of laminar material being adapted to be separated from the box along the pre-cut lines, folded along the respective fold lines, and assembled to one another to form the first dispenser.

2. The package of claim 1, wherein the sheet products are interfolded sheets.

3. The package of claim 1, wherein the laminar material is a sheet of cardboard, or corrugated board.

4. The package of claim 1, wherein the pre-cut lines are perforation lines.

5. The package of claim 1, wherein the fold lines are scored lines.

6. The package of claim 1, wherein a double-sided adhesive is applied to said at least first portion of laminar material.

7. The package of claim 1, wherein:

the box comprises at least four side panels joined to one another along scored lines; and said plurality of portions of laminar material are comprised in a plurality of said side panels and are detachable therefrom along the pre-cut lines.

8. The package of claim 1, wherein:

the fold lines of the first dispenser are configured to form the first dispenser to accommodate a maximum number of the packs of sheet products, the maximum number of the packs of sheet products being less than the plurality of packs of sheet products.

9. The package of claim 1, wherein:

the fold lines of the first dispenser are configured to form the first dispenser to accommodate at least one of the plurality of packs of sheet products, but not all of the plurality of packs of sheet products.

10. The package of claim 1, wherein:

the first portion of laminar material is a minority portion of an initial said laminar material before the first portion is detached;

a remainder of the laminar material after the first portion is detached, is a majority portion of the initial laminar material.

11. A laminar material for producing a box by folding along respective fold lines, wherein:

the laminar material comprises at least four substantially rectangular panels joined to one another along scored lines forming respective folding lines;

at least a first of said substantially rectangular panels comprises a first portion of laminar material delimited by first pre-cut lines, said first portion of laminar material comprising first fold lines;

the first portion of laminar material is configured to be separated from the first one of said substantially rectangular panels along the first pre-cut lines and to be folded along the first fold lines, to form at least a first portion of a dispenser of sheet products;

at least a second of said substantially rectangular panels comprises a second portion of laminar material delimited by second pre-cut lines, said second portion of laminar material comprising second fold lines;

the second portion of laminar material is configured to be separated from the second of said substantially rectangular panels along the second pre-cut lines and to be folded along the second fold lines to form at least a second portion of the dispenser of sheet products; and the first portion of the dispenser and the second portion of the dispenser are configured to be assembled to one another.

* * * * *